United States Patent [19]

Rahn

[11] Patent Number: 5,062,636

[45] Date of Patent: Nov. 5, 1991

[54] THREAD PROTECTOR AND TIP MAINTENANCE DEVICE FOR A BILLIARD CUE

[76] Inventor: Peter R. Rahn, 1460A S. 77th St., West Allis, Wis. 53214

[21] Appl. No.: 470,907

[22] Filed: Jan. 26, 1990

[51] Int. Cl.[5] ..... A63D 15/08

[52] U.S. Cl. ..... 273/68; 273/17

[58] Field of Search ..... 273/68, 70, 17; 403/11, 403/12, 21, 22, 23, 18

[56] References Cited

U.S. PATENT DOCUMENTS

| | | | |
|---|---|---|---|
| 1,391,033 | 9/1921 | Hazelton | 403/21 |
| 3,232,613 | 2/1966 | Laube | 273/68 |
| 3,390,906 | 7/1968 | Wing | 403/11 |
| 4,231,574 | 11/1980 | Williams | 273/68 |
| 4,785,586 | 11/1988 | Kratfel | 273/17 |

FOREIGN PATENT DOCUMENTS

| | | | |
|---|---|---|---|
| 2096470 | 10/1982 | United Kingdom | 273/68 |

*Primary Examiner*—Edward M. Coven
*Assistant Examiner*—Mark S. Graham
*Attorney, Agent, or Firm*—Andrus, Sceales, Starke & Sawall

[57] ABSTRACT

A thread protector and tip scuffer for a breakdown billiard cue includes a separate protector member for each threaded end section of the cue, comprising either a threaded stud or a threaded bore. The protector member is thus either threadable over the stud projecting from the cue end section or into the threaded bore on the other cue end section such that the threads and adjoining faces of the cue sections are protected when disassembled from damage as a result of dropping of the like. The protractor members are threadable axially to one another when not in use and have cylindrical bodies to provide a smooth compact cylindrical assembly. A third end protector may be provided for a cue assembly having an interchangeable alternate tip section, and the additional end protector may be substantially identical to one of the basic two piece set and threadable into one end thereof when not in use. An end of one of the protector members is provided with a concave spherical recess, to which is attached a small circular abrasive sheet, such as sandpaper, for scuffing the cut tip. The sandpaper sheet may be removed and replaced when worn.

12 Claims, 1 Drawing Sheet

THREAD PROTECTOR AND TIP MAINTENANCE DEVICE FOR A BILLIARD CUE

BACKGROUND OF THE INVENTION

The present invention relates to billiard or pool cues and, more particularly, to a device for protecting the threads of a breakdown billiard cue of the type having two threadably attachable sections and including a tool for maintaining or scuffing the tip of the cue.

Billiard or pool cues are often constructed of two threadably attachable sections so they may be conveniently taken apart for storage or transport. Typically, the hand or grip section is provided with an axial threaded stud which is threadable into an internally threaded bushing in the end of the tip section. Some cues are constructed in three sections, including a pair of interchangeable tip sections which may vary from one another in length, weight, taper, or the like. The cue is typically made of wood and the threaded members, inset in the cue ends, are typically made of brass. In addition, many custom-made cues are provided with inlaid cylindrical bands which surround the threaded adjoining ends of the two cue sections. The inlay material may be plastic or even a more exotic material, such as ivory, but in any case is generally harder and substantially more brittle than the wooden cue material.

It is common for the cue owner to carry the two or three section cue in a carrying case for convenience and to remove the two sections comprising the cue and thread them together for use. One or the other of the sections may occasionally be inadvertently dropped or scraped against some surface in the process of removal from or return to the carrying case. Should either of the sections fall or be struck on its threaded end, the metal threads may be distorted or bent, or the wooden edge or inlaid ferrule may be chipped or broken.

After a period of use, the playing tip of the cue, which is often made of leather or a leather-like material, may become smooth from chalking and continued contact with the billiard balls. It is desirable and often necessary to periodically scuff the tip to provide a roughened surface by scraping it with a hard abrasive tool.

It is known in the art to provide a two-piece tip protector comprising two body parts, one of which includes a stud matching the one on the cue handle section and the other having a threaded recess matching the threaded bore on the cue tip section. These protectors are threaded respectively onto the cue sections containing the threaded bore and the stud. This is the sole function provided by the prior art two-piece protector. It is also known to make a small tip scuffing tool in the form of a small block, approximately the size of the chalk blocks used to chalk the cue tip. The scuffing blocks may include one or two concave abrasive surfaces, one of which may be rubbed over the cue tip, in a manner similar to chalking, to roughen the tip surface. Such small tip scuffers are limited strictly to this function and, because of their size, are easily misplaced or lost.

SUMMARY OF THE INVENTION

In accordance with the present invention, there is provided a thread protector and tip scuffer for a breakdown pool cue of the type having two threadably attachable sections. The tip protector includes two pieces, one of which is treadable over the threaded stud on the end of one cue section and the other of which includes a stud which is theadable into the threaded bore in the end of the other cue section. The apparatus is readily adaptable to accommodate a cue assembly having an extra interchangeable tip end. In this embodiment another protector piece including a threaded stud is provided for attachment to the end of the alternate cue tip section to provide tip protection for the entire three-piece set. Either or both of the pieces of the apparatus having threaded studs may include on the opposite end thereof an abrasive surface for scuffing the cue tip. The piece of the apparatus containing the threaded bore for attachment over the threaded stud on the grip end section of the cue may include a threaded through bore such that the entire three-piece apparatus may be conveniently threaded together when not in use.

In the preferred embodiment, the bodies of the two or three pieces comprising the protector apparatus are generally cylindrical in shape and have diameters corresponding to the diameters of the adjoining threaded ends of the two cue sections. One section is provided with a threaded axial through bore having a thread pattern that corresponds to that of the cue and the other end piece or pieces have threaded metal studs mounted axially in the bodies and extending a short distance from the ends thereof, which studs also have thread patterns corresponding to the threadably connected cue section ends. When the pieces of the end protector apparatus are not attached to cue sections, they may be conveniently threaded together to provide a composite compact cylindrical body with a scuffer surface on one or both ends thereof.

Preferably, the bodies of each of the protector pieces are formed of a plastic material. The protector stud threaded into one or two of the pieces is formed of metal. A clear acrylic plastic has been found to be most suitable for both functional and aesthetic purposes. The threaded metal stud or studs are preferably made of brass, corresponding to the material generally used for the threaded connectors in the pool cue section ends.

The end of one of the protector sections not provided with a threaded bore or threaded stud is provided with a spherical concave recess having an abrasive surface. The abrasive surface may comprise a small circular sheet of sandpaper which is preferably removable and replaceable after it has been worn out. In the preferred embodiment, the small circular sandpaper sheet includes an adhesive backing surface for convenient demountable attachment in the spherical concave recess.

DETAILED DESCRIPTION OF THE PREFERRED EMBODIMENT

Figures 1, 2, 3, 4, 5, 6:
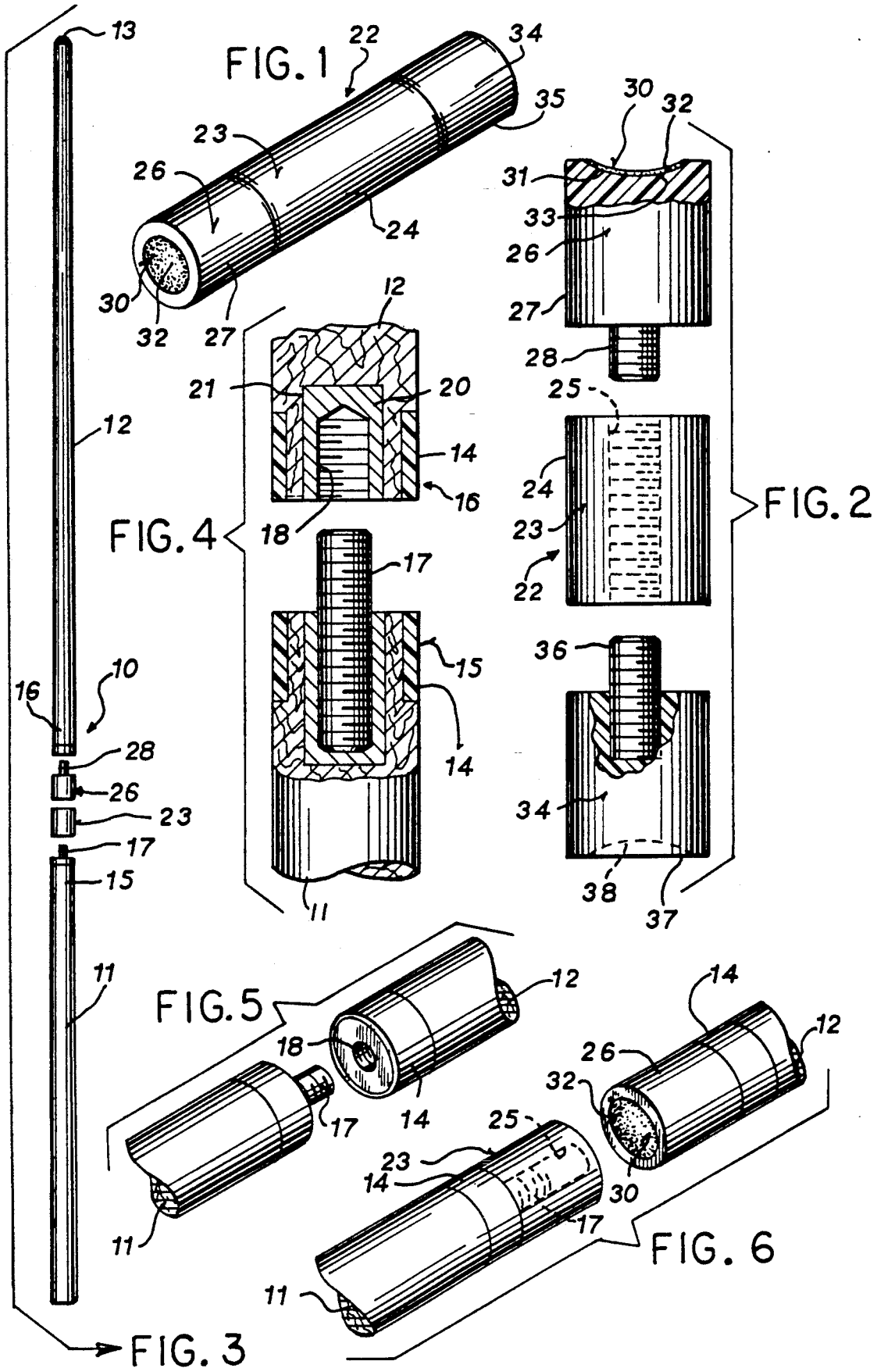
FIG. 1 is a perspective view of a three-piece thread protector and tip scuffer of the present invention shown in its assembled condition in a unitary cylindrical body.
FIG. 2 is an exploded side view of the protection apparatus of FIG. 1 with portions broken away to show details of the interior construction.
FIG. 3 is a side view of a conventional two piece breakdown pool cue with the thread protector of the present invention and showing the pieces unthreaded and separated.
FIG. 4 is an enlarged detail of the adjoining ends of the cue section shown in FIG. 3 partly in section.
FIG. 5 is an enlarged perspective view of the pool cue end sections shown in FIGS. 3 and 4.
FIG. 6 is an enlarged perspecitve view, similar to FIG. 5, showing the thread protector pieces attached to the ends of the cue sections.

Referring initially to FIGS. 3 and 4, a conventional breakdown pool or billiard cue 10 typically includes a handle or grip section 11 and a tip section 12. The two sections are threadably interconnectable for use and may be conveniently unthreaded for transport and storage in a carrying case or the like. One end of the tip section 12 is provided with a conventional tip 13 which may be made of leather or another suitable material which may be suitably roughened and chalked, as is known in the art, to enhance contact between the cue tip and a billiard ball. Both cue sections 11 and 12 are conventionally made of wood.

The adjoining ends 15 and 16 of the grip section and tip section 11 and 12, respectively, may each be provided with an inlaid cylindrical sleeve or ferrule 14. The ferrule 14 may be made of plastic or of a more exotic material, such as ivory, and serves both a decorative purpose and protects the relatively softer and more easily damaged wood at the tip. The end 15 of the grip section 11 is provided with a threaded stud 17 which is threaded axially into the cue section and secured firmly in place therein. The stud 17 extends a short distance axially beyond the end 15. The adjoining end 16 of the tip section 12 is provided with a mating threaded axial bore 18 which receives the threaded stud 17 to secure the two cue sections together. Preferably, the threaded bore 18 comprises the threaded ID of a brass bushing insert 20 which is held in the cue end 16 by a suitably threaded OD 21.

When the cue sections 11 and 12 are disconnected, the threaded stud 17 and both cue section ends 15 and 16, including any ferrule 14 which may be included in the construction, are easily subject to damage should the cue section be dropped or otherwise brought into contact with a hard surface. The threads of the stud may be easily nicked or dented, thereby preventing rethreading into the threaded bore 18. The ferrule 14, whether of plastic or some other material, may be chipped, cracked or broken. Thus, the function and/or appearance of the cue may be damaged significantly if the cue section ends 15 and 16 are unprotected.

Referring also to FIGS. 1 and 2, the thread protector apparatus 22 of the present invention comprises a set of two or three pieces which may be attached together when not in use and separated for individual attachment to the threaded ends of the cue sections to provide the end protection, as will be described hereinafter. The protector 22 includes a center member 23 comprising a short cylindrical body 24 having a threaded axial through bore 25 extending therethrough. The thread pattern of the bore 25 corresponds to the thread pattern on the cue stud 17 and bore 18 in the adjoining ends 15 and 16 of the cue sections. A first end member 26 also includes a cylindrical body 27 and has a threaded metal protector stud 28 axially mounted and extending from one end thereof. The stud 28 may be threaded into a suitable axial bore in the end of the body 27, which bore may initially be smooth or tapped. In either case, the bore should be formed to securely hold the stud 28 against rotation under the normal torque which might be anticipated as the end member 26 is threaded onto the end 16 of the tip section 12 of the cue.

The end member 26 of the protector 22 is provided at the end opposite the stud 28 with a concave spherical recess 30. The recess 30 defines a thin spherical segment and the surface thereof is covered with a thin abrasive sheet 31. The sheet 31 preferably comprises a circular piece of sandpaper having the conventional abrasive coating 32 on the outside surface and an adhesive inner surface 33 by which it may be attached in the concave recess. In this manner, the abrasive sheet 31 may be readily peeled off and replaced after the abrasive coating 32 has been worn. The spherical recess 30 is large enough to readily receive the cue tip 13 so the surface thereof may be appropriately scuffed and roughened as is well known in the art.

In its most basic form, the thread protector 22 may comprise only the center member 23 and the first end member 26 to provide thread protection and a tip scuffing device for a typical two piece cue 10. The center member 23 is threaded onto the stud 17 on the end 15 of the grip section 11, as may best be seen in FIG. 6. Similarly, the first end member 26 is attached to the tip section 12 of the cue by threading the attached protector stud 28 into the threaded bore 18 in the end 16. The cylindrical bodies 24 and 27 of the protector members 23 and 26 are formed with diameters approximately equal to the diameters of the adjoining cue ends 15 and 16. In this manner, the threaded cue ends and inlaid rings or ferrules 14 are fully protected should either cue section be dropped. The smooth continuous cylindrical surfaces between the protector members 23 and 26 and the adjacent cue section bodies allow the sections to be easily inserted into and removed from a carrying case.

To accommodate a pool cue which includes another tip section, similar to tip section 12 and interchangeable therewith, a second end member 34 may comprise part of the composite protector 22. End member 34 is substantially identical to the first end member 26 and includes a cylindrical body 35 in which is mounted a threaded stud 36 which extends a short distance axially from one end. The additional end member 34 is attached to the second interchangeable tip section of the cue in exactly the same manner previously described with respect to the end member 26. Also, for convenience in storage, the end member 34 may be threaded into the threaded through bore 25 in the center member 23 on the end opposite the first end member 26 to provide the overall assembly shown in FIG. 1. The outer end 37 of the body member 34 opposite the threaded stud 36 may be left flat and smooth or may be provided with a concave spherical recess 38 identical to the recess 30 in the first end member 26. If a recess is provided, it may have a different shape or radius and/or be provided with an abrasive sheet having a different coarseness. In this manner, different cue tip shapes may be accommodated or may be provided with varying degrees of roughness.

Typically, the diameter of the cylindrical members 23, 26 and 34 comprising the protector 22 is about $\frac{7}{8}$". This corresponds closely to the diameters at the adjoining ends 15 and 16 of most cues. The spherical segment forming the concave spherical recess 30 (or 38 if included) may have a diameter of about $\frac{5}{8}$" and a spherical radius of about 1". It has been found that protector members formed of a clear acrylic plastic provide both an aesthetically pleasing construction as well as one which is extremely functional. The acrylic plastic is hard and tough enough to avoid cracking or shattering if the cue section is dropped, even at extremely low temperatures. In addition, the plastic is easily machined to provide the threaded through bore 25 in the center member 23 or the bores in the end members for receipt of the threaded stud 28 or 36. These studs are preferably made of brass as are the cue stud 17 and bushing insert 20 and, of course, are provided with identical thread patterns, typically 5/16"-18 as is very common in billiard cue constructions.

If the protector 22 of the present invention is made of only two parts, namely, a first end protector 26 and a second end protector comprising the center member 23, the latter may be provided with a threaded blind bore instead of the through bore 25 of the preferred embodiment. In such a modified two piece construction, the untapped end of the member having the threaded blind bore may also be provided with a spherical recess similar to recess 30.

Various modes of carrying out the present invention are contemplated as being within the scope of the following claims particularly pointing out and distinctly claiming the subject matter which is regarded as the invention.

I claim:

1. A protective and maintenance apparatus for a billiard cue that includes two sections coaxially attached at adjoining cue ends, one of which adjoining cue ends is provided with an axially extending threaded stud and the other of which adjoining cue ends is provided with a threaded axial bore for receipt of the stud to assemble the cue for use, after which it may be disassembled for storage and transport, said apparatus comprising:

a first end protector having a body, a threaded protector stud attached to said body and extending from one end of said body, said protector stud having a thread pattern corresponding to the thread stud on the one adjoining cue end for receipt in the threaded axial bore in the other adjoining cue end;

a second end protector having a body, a threaded protector bore in one end of said body, said protector bore having a thread pattern corresponding to the threaded axial bore in the other adjoining cue end; and, a concave cue tip scuffing means adapted to receive a cue tip and recessed in one of said first and second end protector bodies for maintaining the surface of the cue tip.

2. The apparatus as set forth in claim 1 wherein the bodies of said first and second end protectors are generally cylindrical, said protector stud is mounted on the axis of the cylindrical body of said first end protector, and said protector bore is positioned on the axis of the cylindrical body of said second end protector; and, the diameter of said cylindrical bodies are substantially equal to each other and to the diameter of the adjoining cue ends;

whereby said first and second end protectors may be threadedly attached in direct abutting engagement with said other adjoining cue end and said one adjoining cue end, respectively.

3. The apparatus as set forth in claim 2 wherein said first and second bodies are formed of a plastic material and said threaded protector stud is formed of metal.

4. The apparatus as set forth in claim 3 wherein said plastic material comprises a clear acrylic plastic and the metal comprises brass.

5. The apparatus as set forth in claim 2 for use with a cue that includes a third section having a threaded axial bore which third section is interchangeable with the cue section having said other adjoining cue end, wherein the threaded protector bore in said second end protector extends through the body thereof to provide a second protector bore in the opposite end of said body, and further including a third end protector having a generally cylindrical body with a diameter equal to the diameter of the bodies of said first and second end protectors, a second threaded protector stud attached to the body of said third end protector on the axis thereof, said second protector stud having a thread pattern corresponding to the threaded stud on said one adjoining cue end for receipt in the threaded axial bore in the third cue section.

6. The apparatus as set forth in claim 5 wherein said first and third end protectors are threadably attachable to opposite ends of said second end protector in direct abutting engagement therewith to provide a uniform, smooth unitary cylindrical member.

7. The apparatus as set forth in claim 6 wherein the scuffing means comprises a generally spherical recess having an abrasive surface in the end of one of said first and third end protector bodies opposite the protector stud.

8. The apparatus as set forth in claim 2 wherein said scuffing means comprises an abrasive surface.

9. The apparatus as set forth in claim 8 wherein said concave abrasive surface comprises a spherical segment.

10. The apparatus as set forth in claim 9 wherein said abrasive surface comprises a small circular sheet of sandpaper.

11. The apparatus as set forth in claim 10 wherein said sandpaper sheet is removable and replaceable.

12. The apparatus as set forth in claim 11 wherein said sandpaper sheet includes an adhesive surface opposite said abrasive surface for attachment in said recess.

* * * * *